US008805216B2

(12) United States Patent
Mizutani

(10) Patent No.: US 8,805,216 B2
(45) Date of Patent: Aug. 12, 2014

(54) IMAGE FORMING APPARATUS

(75) Inventor: Naoki Mizutani, Osaka (JP)

(73) Assignee: Kyocera Document Solutions Inc. (JP)

( * ) Notice: Subject to any disclaimer, the term of this patent is extended or adjusted under 35 U.S.C. 154(b) by 242 days.

(21) Appl. No.: 13/034,780

(22) Filed: Feb. 25, 2011

(65) Prior Publication Data

US 2011/0243585 A1 Oct. 6, 2011

(30) Foreign Application Priority Data

Mar. 30, 2010 (JP) ..... 2010-079204

(51) Int. Cl.
*G03G 21/12* (2006.01)
*G03G 21/10* (2006.01)

(52) U.S. Cl.
CPC ..... *G03G 21/10* (2013.01)
USPC ..... 399/35; 399/360

(58) Field of Classification Search
CPC ..... G03G 21/10; G03G 21/12
USPC ..... 399/35, 360
See application file for complete search history.

(56) References Cited

U.S. PATENT DOCUMENTS

| | | | | |
|---|---|---|---|---|
| 4,761,674 | A * | 8/1988 | Ogura | 399/35 |
| 5,038,180 | A * | 8/1991 | Niki | 399/360 |
| 2006/0039710 | A1 * | 2/2006 | Tawada | 399/35 |

FOREIGN PATENT DOCUMENTS

| | | |
|---|---|---|
| JP | H01-142970 | 9/1989 |
| JP | H02-111167 | 9/1990 |
| JP | H02-113757 | 9/1990 |
| JP | 05-297775 | 11/1993 |
| JP | 2006-154411 | 6/2006 |
| JP | 2007-310139 | 11/2007 |
| JP | 2009-063772 | 3/2009 |

* cited by examiner

*Primary Examiner* — Benjamin Schmitt
(74) *Attorney, Agent, or Firm* — Ostrolenk Faber LLP

(57) ABSTRACT

This image forming apparatus includes: a waste toner recovery bottle that recovers waste toner; a detection member that is flexible and is loaded in the waste toner recovery bottle, and that bulges upwards in accordance with the recovered amount of waste toner collected in the waste toner recovery bottle; and a recovered amount detection unit that detects the recovered amount using the bulging of the detection member. The recovered amount detection unit detects that the waste toner recovery bottle is full before the bulging of the detection member protrudes beyond a plane that includes an outer wall surface of the waste toner recovery bottle.

13 Claims, 4 Drawing Sheets

IMAGE FORMING APPARATUS

BACKGROUND OF THE INVENTION

1. Field of the Invention

The present invention relates to an image forming apparatus.

Priority is claimed on Japanese Patent Application No. 2010-079204, filed Mar. 30, 2010, the contents of which are incorporated herein by reference.

2. Description of Related Art

Conventional image forming apparatuses such as copiers, printers, fax machines, or multifunction printers which are provided with a plurality of the functions of these apparatuses have been proposed. In these image forming apparatuses, waste toner that has already been used is recovered by being conveyed to a waste toner recovery bottle. When this waste toner recovery bottle is full, the full waste toner recovery bottle is replaced with an empty waste toner recovery bottle.

A description will now be given of the waste toner recovery when the image forming apparatus is a full-color type of apparatus. Firstly, basic description of the image forming apparatus will be given. In this image formation apparatus, a plurality of photoconductors which are formed by drums that correspond respectively to the colors of yellow (Y), magenta (M), cyan (C), and black (BK) are prepared. Predetermined electrostatic latent images are formed on the circumferential surface of each photoconductor using a laser scanning unit, and toner images of each color are created respectively using supplied toner of each color. The toner images of each color that are formed on the circumferential surface of each photoconductor are then sequentially superimposed and transferred in a transfer belt which is formed by a rotating endless belt. As a result, a color image is synthesized on the transfer belt. Next, the color image that has been synthesized on this transfer belt is transferred onto a transfer material such as copy paper or the like. After that, the color image is pressurized, heated and fixed. The toner remaining on the transfer belt after the toner image haps been transferred onto the transfer material is then removed by a cleaning apparatus. The transfer belt that has been cleaned by this cleaning apparatus is sent back to the respective photoconductors once again and is used for the synthesizing of the next color image.

The cleaning apparatus is provided on the downstream side of the position of the transfer onto the transfer material, and on the upstream side of the position of the first photoconductor in the rotation direction of the transfer belt. The cleaning apparatus is provided with a conveying mechanism and a waste toner recovery bottle. The conveying mechanism is provided with a cleaning blade that slides along in contact with the surface of the transfer belt, and with a screw or the like that conveys remaining toner that has been removed by the cleaning blade. The waste toner recovery bottle stores waste toners conveyed to it by the conveying mechanism.

The waste toner recovery bottle can be freely mounted on and removed from a main unit of the image forming apparatus. In addition, when a full-bottle sensor has detected that the waste toner recovery bottle is full of waste toner, a user is notified of this fact, and operations of the image forming apparatus are halted. The waste toner recovery bottle is then extracted from the main unit of the image forming apparatus. Next, an empty waste toner recovery bottle is newly set in the main unit of the image forming apparatus main unit, and operations of the image forming apparatus are recommenced.

However, if the above described full-bottle sensor uses the expansion of a flexible detection member that is provided on a portion of the waste toner recovery bottle to detect that the bottle is full, then if the waste toner recovery bottle is then extracted from the main unit while this detection member is still in its expanded state, there is a possibility that the expanded portion will come into contact with the main unit and become damaged. There is a possibility that the waste toner disperses inside the apparatus.

SUMMARY OF THE INVENTION

The present invention adopts the following measures in order to solve the above-described problems and achieve the object of the present invention.

(1) The image forming apparatus according to an aspect of the present invention is provided with: a waste toner recovery bottle that recovers waste toner; a detection member that is flexible and is fitted in the waste toner recovery bottle, and that bulges upwards in accordance with the recovered amount of waste toner collected in the waste toner recovery bottle; and a recovered amount detection unit that detects the recovered amount by the bulging of the detection member, wherein the recovered amount detection unit detects that the waste toner recovery bottle is full before the bulging of the detection member protrudes beyond a plane that includes an outer wall surface of the waste toner recovery bottle.

According to the image forming apparatus described in above (1), the recovered amount detection unit is able to detect that the waste toner recovery bottle is full without the bulging of the flexible detection member protruding beyond a plane that includes the outer wall surface of the waste toner recovery bottle. As a result, even if the waste toner recovery bottle is extracted from the main unit while the detection member is in an expanded state, because the expanded portion of the detection member does not make contact with the main unit side, there is no possibility of the detection member becoming damaged, and it is possible to effectively prevent the waste toner becoming dispersed inside the apparatus.

DETAILED DESCRIPTION OF THE INVENTION

Figure 1:
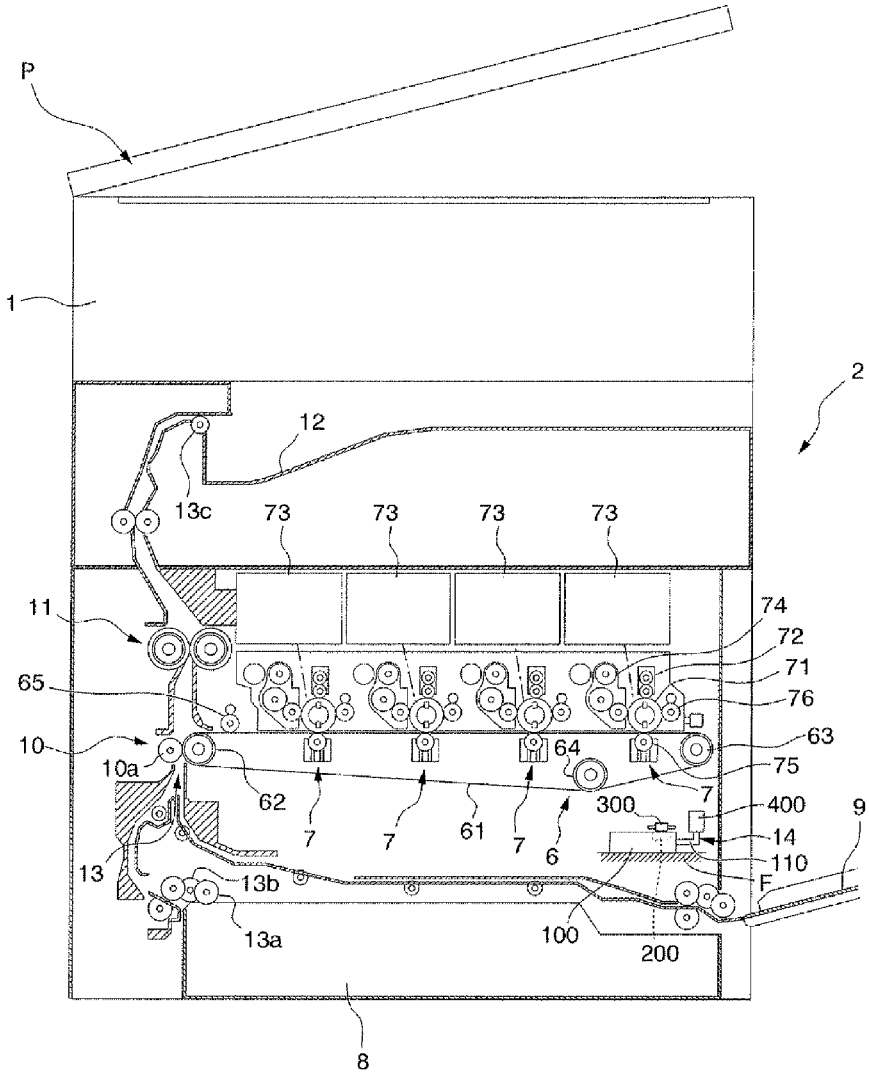
FIG. 1 is a cross-sectional view showing the schematic structure of a copier in which the image forming apparatus according to an embodiment of the present invention has been applied.

The invention was made with respect to the above-described problems, and it is an object thereof to provide an image forming apparatus that is structured such that the detection member does not come into contact with the main unit side when the waste toner recovery bottle is being extracted from the main unit.

An embodiment of the image forming apparatus of the present invention will now be described with reference made to the drawings. In the drawings described below, the scale of each member has been suitably altered in order to make each member a recognizable size. In addition, in the following description, a copier is described as an example of the image forming apparatus of the present invention.

FIG. 1 is a perspective view of an electrophotographic type of full-color copier P. In the same way as commonly known copiers, this copier P is provided with an image reading unit 1 that reads an image of an original document, and a printing unit 2 that prints onto recording paper (i.e., a recording medium) based on the read image data.

The image reading unit 1 irradiates light onto an image of an original document, and by receiving reflected light therefrom reads the original document image as an image data. The image reading unit 1 is provided with a light source unit that irradiates light onto an original document, and with a light-receiving sensor that receives feedback light from the original document and converts it into the image data.

The printing unit 2 is provided with a belt unit 6, image formation units 7, a paper feed cassette 8, a paper feed tray 9, a secondary transfer unit 10, a fixing unit 11, a paper discharge tray 12, a conveying path 13, and a waste toner recovery unit 14.

Toner images formed in the image formation units 7 are transferred onto the belt unit 6, and the belt unit 6 conveys these transferred toner images. The belt unit 6 is provided with an intermediate transfer belt 61 onto which toner images are transferred from the image formation units 7, a drive roller 62 that aerially suspends the intermediate transfer belt 61 and also causes it to rotate endlessly, a slave roller 63, a tension roller 64, and a cleaning unit 65.

The intermediate transfer belt 61 is aerially suspended under tension by the drive roller 62, the slave roller 63, and the tension roller 64.

The drive roller 62 is connected to a drive unit having a drive source such as a motor or the like, and adds gripping force to the intermediate transfer belt 61. As a result, the intermediate transfer belt 61 rotates along the drive roller 62, the slave roller 63, and the tension roller 64.

The slave roller 63 is driven to rotate by receiving rotation drive from the drive roller 62.

The tension roller 64 is a type of slave roller that is driven to rotate by receiving the rotation drive from the drive roller 62, and has a spring mechanism that is used to add tension to the intermediate transfer belt 61.

The cleaning unit 65 is provided on the downstream side of the position of the drive roller 62, and on the upstream side of the first image formation unit 7 (i.e., the yellow (Y) unit) in the rotation direction of the intermediate transfer belt 61. This cleaning unit 65 has a cleaning blade (not shown) that slides along in contact with the surface of the intermediate transfer belt 61, and has a structure that enables it to remove a remaining toner (i.e., waste toner) to the intermediate transfer belt 61 and clean the surface of the intermediate transfer belt 61. In this structure, the waste toner that is removed by this cleaning unit 65 can be conveyed to the waste toner recovery unit 14 via a conveying mechanism (not shown) which is provided with a screw or the like.

In the example shown in the drawings, nothing is shown on the opposite side of the intermediate transfer belt 61 from the cleaning unit 65, however, this is only to make the drawings simpler. In actuality, in order for waste toner to be efficiently removed, a group of rollers or a roller that are able to press the intermediate transfer belt 61 against the cleaning unit 65 during cleaning are provided in this location.

The image formation units 7 are provided so as to correspond individually to the respective colors of yellow (Y), magenta (M), cyan (C), and black (BK), and form toner images in their respective colors. In addition, these image formation units 7 are arrayed in the above sequence moving from the upstream side to the downstream side in the rotation drive direction of the intermediate transfer belt 61.

Each image formation unit 7 has a photoconductor 71, a charging unit 72, a laser scanning unit 73, a developing apparatus 74, a primary transfer roller 75, a cleaning apparatus 76, and a static charge eliminator (not shown) and the like.

The shape of the photoconductor 71 is set as a circular column, and electrostatic latent images and also toner images that are based on these electrostatic latent images are formed on the circumferential surface thereof. The charging unit 72 is positioned facing the photoconductor 71, and keeps the circumferential surface of the photoconductor 71 in a charged state. The laser scanning unit 73 scans laser light which is emitted based on print mode image data onto the circumferential surface of the charged photoconductor 71.

The developing apparatus 74 develops a toner image that is based on the electrostatic latent image on the circumferential surface of the photoconductor 71 by supplying a toner to the circumferential surface of the photoconductor 71.

The primary transfer roller 75 is positioned facing the photoconductor 71 with the intermediate transfer belt 61 sandwiched between them, and performs the primary transfer of the toner images developed on the photoconductor 71 onto the intermediate transfer belt 61. The cleaning apparatus 76 removes the remaining toner from the photoconductor 71 after the primary transfer.

The paper feed cassette 8 can be freely withdrawn from the apparatus main body and stores recording paper. The paper feed tray 9 can be freely opened and closed relative to the apparatus main body, and stores recording paper.

The secondary transfer unit 10 performs the secondary transfer of the images formed on the intermediate transfer belt 61 onto a recording medium, and is provide with the drive roller 62 which drives the intermediate transfer belt 61, and a secondary transfer roller 10*a* that is positioned facing the drive roller 62 with the intermediate transfer belt 61 sandwiched between them.

The fixing unit 11 fixes onto recording paper the toner image that has undergone the secondary transfer onto the recording medium, and is provided with a heating roller that fixes the toner image onto the recording paper by applying pressure and heat thereto.

The conveying path 13 is provided with a pickup roller 13*a* that conveys recording paper out from the paper feed cassette 8, a paper supply roller 13*b* that conveys the recording medium, and a paper discharge roller 13*c* that discharges the recording medium to the paper discharge tray 12.

The waste toner recovery unit 14 is provided with a waste toner recovery bottle, a detection member, and a recovered amount detection unit. In this structure, waste toner that has been removed by the above described cleaning unit 65 is collected and recovered by the waste toner recovery unit 14. The waste toner recovery unit 14 is described below in detail using the drawings.

In the copier P which has the above described structure, as is described above, image data is acquired in the image reading unit 1, and color printing onto recording paper is performed in the printing unit 2 based on this image data.

The waste toner recovery unit 14 will now be described using FIG. 2 through FIG. 6. This waste toner recovery unit 14 is provided with a waste toner recovery bottle 100, a detection member 200, and a recovered amount detection unit 300. This waste toner recovery unit 14 is provided in a location where a comparatively large space can be secured inside the main unit of the copier P. Moreover, this location is one that is visible to the outside when a cover (not shown) of the copier P is opened, and that also enables the waste toner recovery bottle 100 to be easily inserted in and extracted from the copier P.

Figure 2:
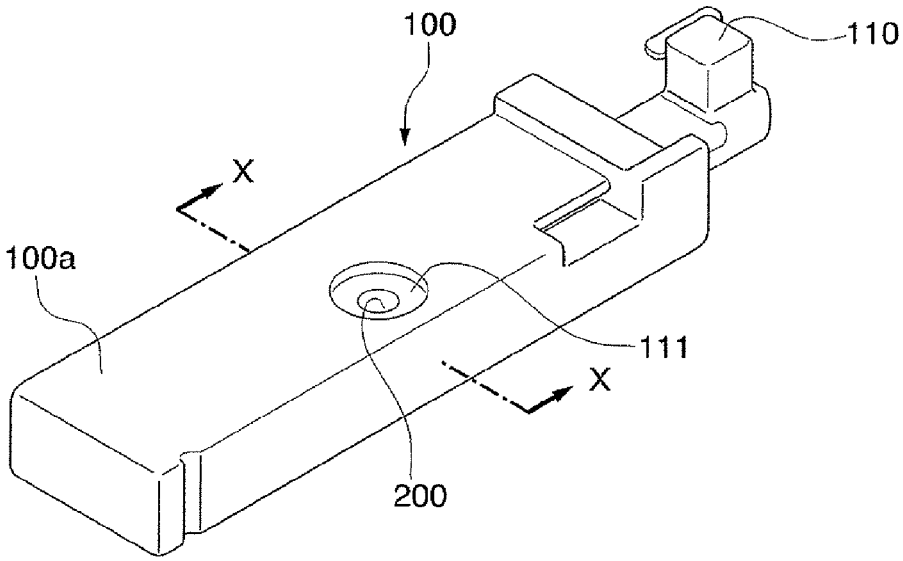
FIG. 2 is a perspective view of a waste toner recovery bottle of the image forming apparatus.

As shown in FIG. 2, the waste toner recovery bottle 100 is a container that is made from synthetic resin in the shape of a cube having a predetermined internal space. A recovery aperture 110 is provided in one end portion in the longitudinal direction of this container. Waste toner recovered by the cleaning unit 65 is collected inside the waste toner recovery bottle 100 through a discharge spout 400 of a waste toner which is provided on a frame F side of the main unit side of the copier P.

Namely, this waste toner recovery bottle 100 is formed such that the recovery aperture 110 of the waste toner recovery bottle 100 and the discharge spout 400 are joined together when the waste toner recovery bottle 100 is installed in a predetermined recovery bottle housing portion (not shown) which is provided in the frame F on the main unit side of the copier P. A shutter (not shown) that closes off the discharge spout 400 when the waste toner recovery bottle 100 has been removed from the copier P is provided on the inner side of this discharge spout 400.

Figure 3:
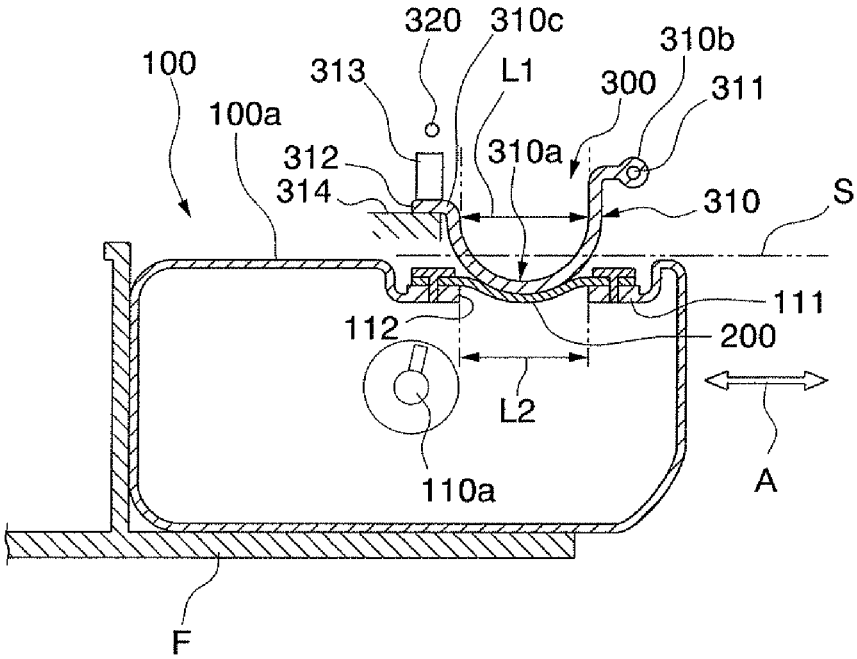
FIG. 3 is a cross-sectional view of a recovered amount detection unit of the image forming apparatus, and is a cross-sectional view taken at a position corresponding to a cross-sectional line X-X across the waste toner recovery bottle shown in FIG. 2.
Figure 4:
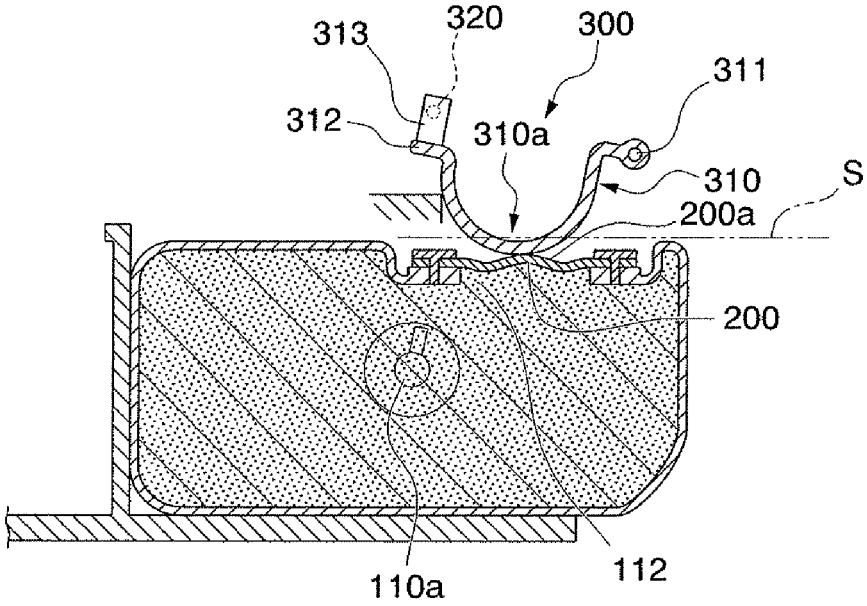
FIG. 4 is a cross-sectional view showing an operational state of the recovered amount detection unit of the image forming apparatus.

In addition, a pushing mechanism 110*a* having a screw conveyor that pushes waste toner entering the recovery spout 110 into the bottle interior is provided on the recovery spout 110 side of the interior of the waste toner recovery bottle 100 (see FIGS. 3 and 4).

The detection member 200 is located in the waste toner recovery bottle 100, and is flexible so that it bulges upwards in accordance with the recovered amount of waste toner collected in the waste toner recovery bottle 100. Specifically, the detection member 200 is shown in FIGS. 3 and 4, and is formed by a membrane material such as flexible rubber. This detection member 200 is provided in a mounting portion 111 (i.e., a concave portion) which is provided in a portion of a top surface 100*a* of the waste toner recovery bottle 100, and the bulging of the detection member 200 is detected by the recovered amount detection unit 300. The mounting portion 111 of the waste toner recovery bottle 100 is dented inwards from the position of the top surface 100*a* of the waste toner recovery bottle 100.

As shown in FIG. 3, the mounting portion 111 of the waste toner recovery bottle 100 includes an aperture portion 112 that is formed in a central portion of the mounting portion 111. The detection member 200 is provided so as to loosely cover this aperture portion 112.

When a contact member 310 (described below) has been mounted on the detection member 200 and the space under the detection member 200 has not yet been filled by waste toner, the detection member 200 sags inside the waste toner recovery bottle 100 due to the weight of the contact member 310 (see FIG. 3).

Furthermore, because the detection member 200 has flexibility, when the inside of the waste toner recovery bottle 100 becomes full of waste toner, the detection member 200 bulges upwards towards the outer side of the top surface 100*a* of the waste toner recovery bottle 100 (see FIG. 4). When the detection member 200 is bulging upwards, as shown in the enlarged view in FIG. 5, a height dimension D1 from a bottom portion 111*a* of the mounting portion 111 to the top portion of the detection member 200 is lower than a depth dimension D2 of the mounting portion 111.

The depth D2 of the dent in the mounting portion 111 is formed as shallow as possible without a top end portion 200*a* of the detection member 200 when the detection member 200 is bulging upwards towards the outer side of the top surface 100*a* of the waste toner recovery bottle 100 protruding beyond a plane S that includes the top surface (i.e., the outer wall surface) of the waste toner recovery bottle 100. This depth D2 is devised such that the waste toner storage capacity of the waste toner recovery bottle 100 should not reduce.

It is not absolutely essential for the mounting portion (i.e., the concave portion) 111 to be provided, and it is also possible for the detection member 200 to be located on the same plane as the top surface 100*a* of the waste toner recovery bottle 100. However, by providing the mounting portion 111, it is possible to broaden the range over which the top end portion of the detection member 200 is able to move without protruding beyond the plane S that includes the top surface (i.e., the outer wall surface) of the waste toner recovery bottle 100. It is possible to improve the detection accuracy.

The recovered amount detection unit 300 detects the recovered amount of waste toner which has been collected inside the waste toner recovery bottle 100 by the bulging of the detection member 200. Namely, the recovered amount detection unit 300 detects that the waste toner recovery bottle 100 is full before the bulging of the detection member 200 has protruded beyond the plane S (i.e., the top surface 100*a* of the waste toner recovery bottle 100 of the present embodiment) that includes the outer wall surface of the waste toner recovery bottle 100 (i.e., while it is still within a range that does not extend beyond this plane). The recovered amount detection unit 300 is provided with the contact member 310 and a detection sensor 320.

As shown in FIG. 3, the contact member 310 is provided with a curved portion 310*a* that curves towards the inside of the waste toner recovery bottle 100. This curved portion 310*a* is curved so as to bulge downwards when viewed from the attachment and removal direction of the waste toner recovery bottle 100 (see the arrow A in FIG. 3) provided in the frame F of the main unit of the copier P. In addition, one end portion 310*b* (i.e., the right end portion in FIG. 3) of the contact member 310 is supported on the frame F such that it is able to rotate freely around a supporting shaft 311. According this structure, the contact member 310 is gradually rotated around the supporting shaft 311 correspondingly to the increase in the bulging of the detection member 200.

Moreover, the curved portion 310*a* of this contact member 310 is set at a size that enables it to be inserted into the aperture portion 112 of the waste toner recovery bottle 100. Namely, a dimension L1 of the inner radius of the contact member 310 is substantially the same as a dimension L2 of the inner radius of the aperture portion 112. In this embodiment, the dimension L1 of the inner radius is substantially the same as the dimension L2 of the inner radius. However, it is not necessary that the dimension L1 of the inner radius is the same as the dimension L2 of the inner radius. That is, the contact member 310 may have other curving shape (curvature). In addition, the contact member 310 is positioned such that, when the waste toner recovery bottle 100 is loaded into the recovery bottle housing portion in the frame F on the copier main unit side, the curved portion 310*a* is located above the aperture portion 112 and is in contact with the detection member 200.

The contact member 310 is gradually displaced as the bulging of the detection member 200 increases. The detection sensor 320 detects this displacement of the contact member 310. As a result, prior to the detection member 200 extending beyond the above described plane S, the contact member 310 detects the displacement of the contact member 310 and causes the detection sensor 320 to operate.

A stopper portion 312 (see FIG. 3) that maintains a state in which the curved portion 310*a* of the contact member 310 is positioned in the aperture portion 112 is provided at another end portion 310*c* of the contact member 310. This stopper portion 312 sit on a receiving portion 314 which is provided on the frame F side due to the weight of the contact member 310. A light-shielding piece (i.e., a light-shielding member) 313 that protrudes slightly upwards is provided on a top portion of this stopper portion 312. When the light-shielding piece 313 is raised to a position corresponding to the detection sensor 320, the detection sensor 320 operates.

Figure 6:
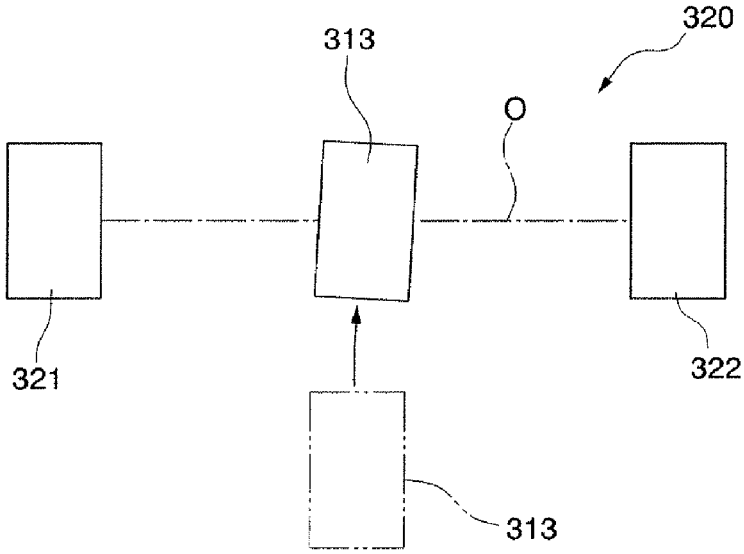
FIG. 6 is a plan view showing a detection sensor of the image forming apparatus.

As shown in FIG. 6, the detection sensor 320 is a photoelectric sensor that is provided with a light-emitting element (i.e., a light source element) 321 that emits light, and a light-receiving element 322 that receives light emitted from the light-emitting element 321.

The light-emitting element 321 and the light-receiving element 322 are provided on the frame F side of the main unit side of the copier P such that, when the contact member 310 has rotated around the supporting shaft 311, the rotation trajectory of the light-shielding piece 313 cuts across the optical axis O of the light emitted from the light-emitting element 321. The interval between the light-emitting element 321 and the light-receiving element 322 of the detection sensor 320 is set such that the light-shielding piece 313 is able to be interposed between them. In addition, the heights of the light-emitting element 321 and the light-receiving element 322 of the detection sensor 320 are set higher than the height of the light-shielding piece 313 when the detection member 200 is sagging downwards (as in FIG. 3), and at a height where they face the light-shielding piece 313 when the detection member 200 is bulging upwards while still not protruding beyond the plane S (as in FIG. 4).

By using this detection sensor 320 it is possible to detect that the contact member 310 has moved vertically within the range of the depth of the dent of the mounting portion 111 in the waste toner recovery bottle 100. Namely, when light emitted from the light-emitting element 321 is shielded by the light-shielding piece 313, the recovered amount detection unit 300 detects that the waste toner recovery bottle 100 is full.

It is also possible to use what is known as a reflective sensor instead of using the above-described transmission type of sensor for the detection sensor 320. In this case, a reflective plate is installed in place of the light-shielding piece 313, and the detection sensor 320 is operated by causing this reflective plate to face the detection sensor. In this case, the light-emitting element 321 and the light-receiving element 322 are placed on the same side, and when light reflected by the reflective plate is received by the light-receiving element 322, the recovered amount detection unit 300 detects that the waste toner recovery bottle 100 is full of waste toner.

The copier P of the present embodiment is provided with a control unit (not shown) that performs overall control. This control unit is electrically connected to the detection sensor 320 and determines that the waste toner recovery bottle 100 is full as a result of the detection sensor 320 operating. Specifically, when light emitted from the light-emitting element 321 is received by the light-receiving element 322, then because this is due to the detection sensor 320 not being shielded by the light-shielding piece 313 (i.e., being in the position shown by the single dot-chain line in FIG. 6), it is determined that the waste toner recovery bottle 100 is not full. Moreover, when light emitted from the light-emitting element 321 is being shielded by the light-shielding piece 313 (i.e., is in the position shown by the solid line in FIG. 6), namely, when the amount of light received by the light-receiving element 322 decreases, it is determined by the recovered amount detection unit 300 that the waste toner recovery bottle 100 is full of waste toner.

In the waste toner recovery unit 14 having the above-described structure, the waste toner recovery bottle 100 is installed in the recovery bottle housing portion in the frame F on the main unit side. When the recovery spout 110 of the waste toner recovery bottle 100 is coupled to the waste toner discharge spout 400 provided inside the main unit of the copier P, the curved portion 310*a* of the contact member 310 of the recovered amount detection unit 300 is positioned in the aperture portion 112 (see FIG. 3). In this state, because the detection sensor 320 is not being shielded by the light-shielding piece 313 (i.e., is in the position shown by the single dot-chain liner in FIG. 6), it is determined that the waste toner recovery bottle 100 is not full.

In contrast, when the waste toner recovery bottle 100 has become full of waste toner, the detection member 200 bulges upwards towards the outward side of the top surface of the waste toner recovery bottle 100 while still within a range whereby it does not protrude past the above described plane S (see FIG. 4). As a result, because the detection sensor 320 changes to a state of being shielded by the light-shielding piece 313 (due to the light-shielding piece 313 moving to the position shown by the solid line in FIG. 6), it is determined that the waste toner recovery bottle 100 is full. In this manner, when it is detected that the waste toner recovery bottle 100 is full, this fact is reported on a display screen (such as a front panel or the like—not shown) of the copier P, and operations of the copier P are suspended.

Figure 5:
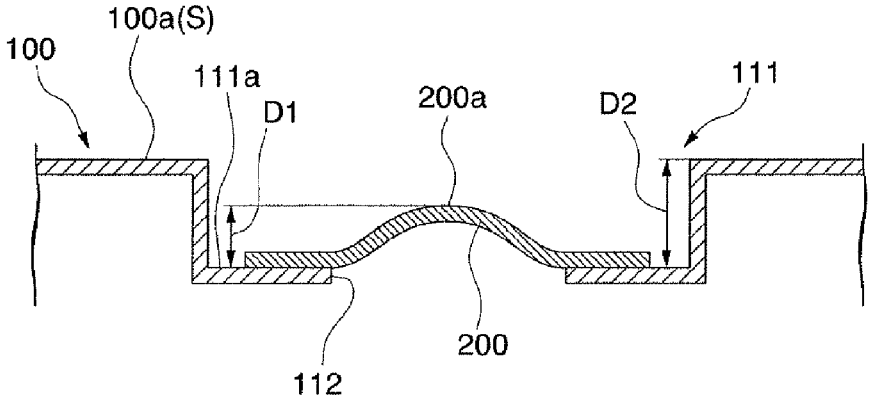
FIG. 5 is an enlarged view showing in typical form a mounting portion shown in FIG. 4.

Here, when the waste toner recovery bottle 100 is full, as shown in FIG. 5, the top surface of the detection member 200 is still not protruding past the plane S which includes the outer wall surface of the waste toner recovery bottle 100. As a result, the detection member 200 does not come into contact with any external members when the waste toner recovery bottle 100 is being extracted from the recovery bottle housing portion in the frame F on the main unit side, and it is possible to effectively prevent any damage to the detection member 200.

Moreover, when the waste toner recovery bottle 100 is being loaded into the recovery bottle housing portion inside the copier P, by causing the curved portion 310*a* of the contact member 310 to come into contact with the top surface of the waste toner recovery bottle 100, the contact member 310 is easily lifted up. Thereafter, when the waste toner recovery bottle 100 is loaded, because the contact member 310 has been placed in contact with the detection member 200, the waste toner recovery bottle 100 can be smoothly loaded without this operation being obstructed by the contact member 310.

A preferred embodiment of the present invention has been described above with reference made to the attached drawings, however, it is to be understood that the present invention is not limited solely to the above described embodiment. The various configurations and combinations and the like of the respective member elements illustrated in the above-described embodiment are just one example thereof, and various modifications are possible based on design requirements and the like insofar as they do not depart from the scope of the present invention.

For example, in the above-described example a structure is employed in which only waste toner that has been removed by the cleaning unit 65 above the intermediate transfer belt 61 is collected and recovered, however, it is also possible for waste toner removed by the cleaning apparatus 76 of the image formation units 7 to be collected as well.

Moreover, in the above-described example a description is given of the recovery of full-color waste toner, however, the present invention may also be applied to the recovery of monochrome waste toner.

Moreover, in the above-described example a structure is described in which whether or not the waste toner recovery bottle 100 is full is detected by detecting the bulging of the detection member 200. However, it is also possible to detect states prior to the waste toner recovery bottle 100 becoming full by detecting the bulging of the detection member 200.

What is claimed is:

1. An image forming apparatus comprising:

a waste toner recovery bottle that recovers waste toner;

a detection member that is flexible and is fitted in the waste toner recovery bottle, and that bulges upwards in accordance with the recovered amount of waste toner collected in the waste toner recovery bottle; and a recovered amount detection unit that has a contact member includes a curved portion that curves towards the inside of the waste toner recovery bottle and detects the recovered amount by the bulging of the detection member, wherein the recovered amount detection unit detects that the waste toner recovery bottle is full before the bulging of the detection member protrudes beyond a plane that includes an outer wall surface of the waste toner recovery bottle;

the detection member sags towards an inside of the waste toner recovery bottle;

a concave portion, that is concave toward the inside of the waste toner recovery bottle from a top surface of the waste toner recovery bottle, is formed in the waste toner recovery bottle;

an aperture portion is formed in the concave portion;

the detection member is positioned in the aperture portion; and a dimension of an inner radius of the contact member is substantially the same as a dimension of an inner radius of the aperture portion.

2. The image forming apparatus according to claim 1, wherein the recovered amount detection unit is further provided with:

the contact member that displaces gradually correspondingly to the bulging of the detection member; and a detection sensor that detects the displacement of the contact member.

3. The image forming apparatus according to claim 2, wherein:

the contact member is gradually rotated around a supporting shaft as the detection member bulges; and when the contact member reaches a predetermined position, the recovered amount detection unit detects that the waste toner recovery bottle is full.

4. The image forming apparatus according to claim 3, wherein:

the concave portion that is hollowed out towards the interior from the plane is formed in the waste toner recovery bottle; and the aperture portion is formed in the concave portion.

5. The image forming apparatus according to claim 2, wherein:

the detection sensor is provided with:

a light source element that emits light; and a light-receiving element that receives the light emitted from the light source element.

6. The image forming apparatus according to claim 5, wherein:

a light-shielding member is provided in the contact member; and when light emitted from the light source element is shielded by the light-shielding member, the recovered amount detection unit detects that the waste toner recovery bottle is full.

7. The image forming apparatus according to claim 6, wherein:

the concave portion that is hollowed out towards the interior from the plane is formed in the waste toner recovery bottle; and the aperture portion is formed in the concave portion; and the detection member is positioned in the aperture portion.

8. The image forming apparatus according to claim 5, wherein:

the concave portion that is hollowed out towards the interior from the plane is formed in the waste toner recovery bottle; and the aperture portion is formed in the concave portion; and the detection member is positioned in the aperture portion.

9. The image forming apparatus according to claim 2, wherein:

the concave portion that is hollowed out towards the interior from the plane is formed in the waste toner recovery bottle; and the aperture portion is formed in the concave portion; and the detection member is positioned in the aperture portion.

10. The image forming apparatus according to claim 2, wherein:

the contact member is provided with a curved portion that curves towards internal portions of the waste toner recovery bottle; and the curved portion of the contact member is located above the aperture portion, and is positioned so as to be in contact with the detection member.

11. The image forming apparatus according to claim 1, wherein:

the concave portion that is hollowed out towards the interior from the plane is formed in the waste toner recovery bottle; and the aperture portion is formed in the concave portion; and the detection member is positioned in the aperture portion.

12. The image forming apparatus according to claim 11, wherein:

when the detection member is bulging upwards, a height dimension of a top portion of the detection member from a bottom surface of the concave portion is smaller than a depth dimension of the concave portion.

13. The image forming apparatus according to claim 1, wherein the concave portion has an inner wall that extends toward inside of the waste toner recovery bottle to a depth below the plane that includes the outer wall surface of the waste toner recovery bottle and terminates at a bottom portion, the aperture being defined in the bottom portion.

* * * * *